United States Patent [19]

Hanson

[11] 4,004,732

[45] Jan. 25, 1977

[54] SNOW MAKING METHOD

[76] Inventor: Alden W. Hanson, 1605 St. Andrews Drive West, Midland, Mich. 48640

[22] Filed: Oct. 31, 1975

[21] Appl. No.: 627,890

Related U.S. Application Data

[63] Continuation-in-part of Ser. No. 497,839, Aug. 16, 1974, abandoned.

[52] U.S. Cl. ..... 239/2 S; 239/14

[51] Int. Cl.[2] ..... F25C 3/04

[58] Field of Search ..... 239/2 S, 14, 77, 178, 239/227, 226, 225, 246

[56] References Cited

UNITED STATES PATENTS

| | | | |
|---|---|---|---|
| 2,635,920 | 4/1953 | Boyce | 239/77 |
| 2,676,471 | 4/1954 | Pierce, Jr. | 239/2 S |
| 3,838,815 | 10/1974 | Rice | 239/2 S |

OTHER PUBLICATIONS

"Hedco Snow", Model H-2d, advertising sheets.

*Primary Examiner*—John J. Love
*Attorney, Agent, or Firm*—James B. VanderKelen

[57] ABSTRACT

The invention is an improved snow-making machine and method of making snow by effecting crystallization of a water spray in a moving, high volume, unidirectional mechanical movement of air wherein the discharge end of the snow-making apparatus is regularly redirected during operation such that the area of snow particle deposition obtained by the moving discharge end is at least three times greater than the actual area covered by the snow pattern formed by the particles issuing from the discharge end and the movement of the discharge end is at a rate and defines a pattern such that the resultant snow particles are directed to a different portion of the atmosphere and subsequently deposited at a different location than the immediately previously generated particles.

5 Claims, 7 Drawing Figures

Fig. 1
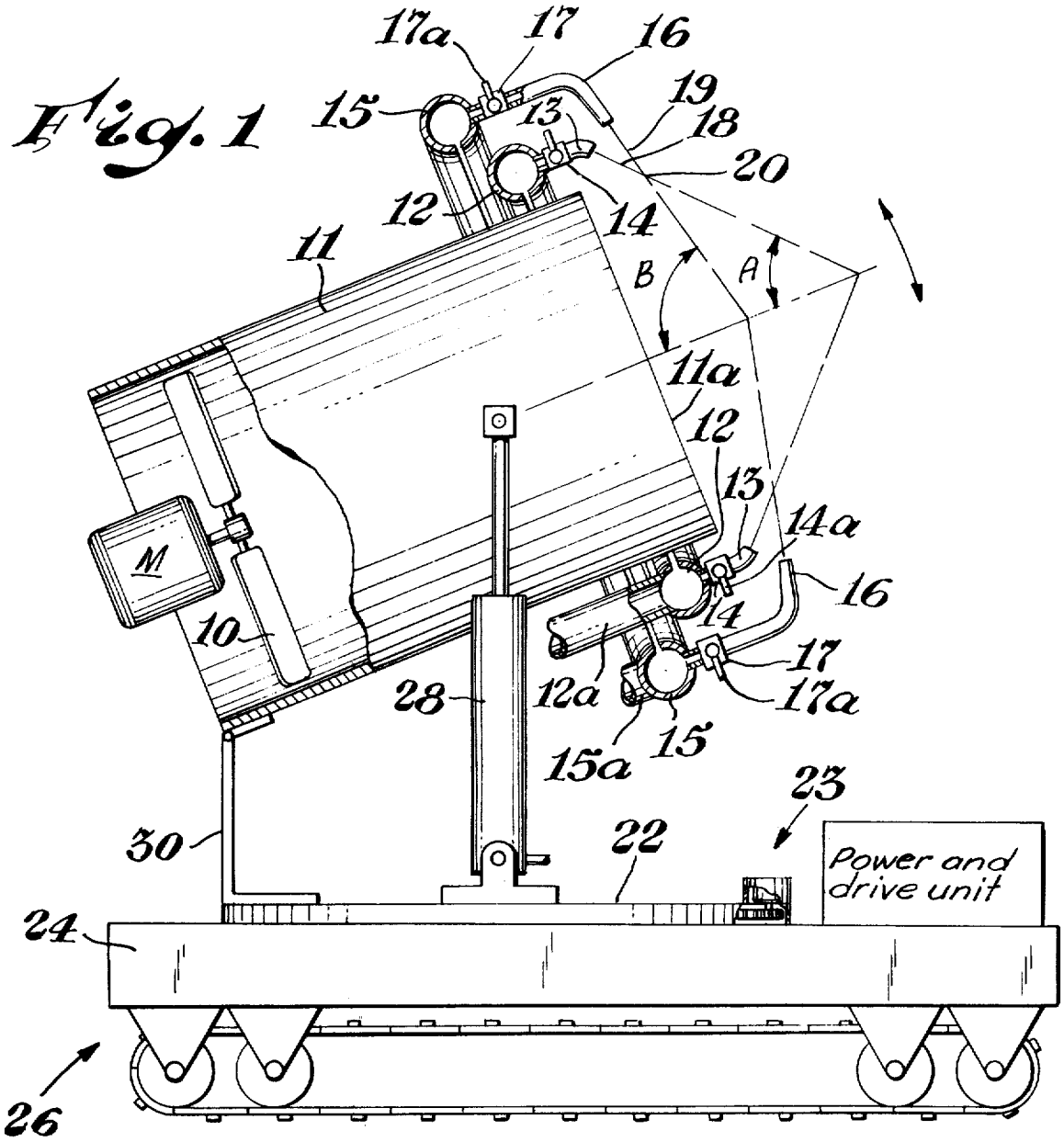
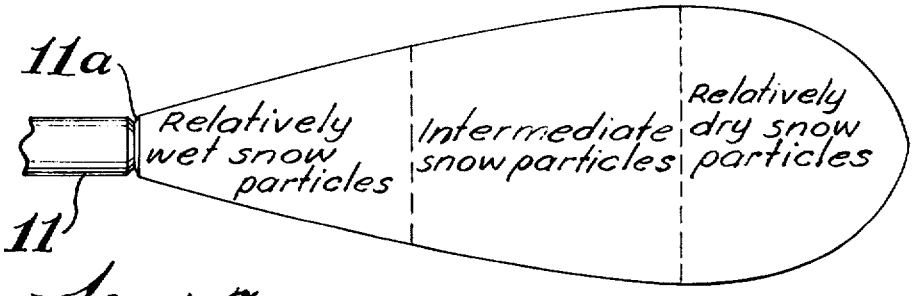
Fig. 3

Fig. 2
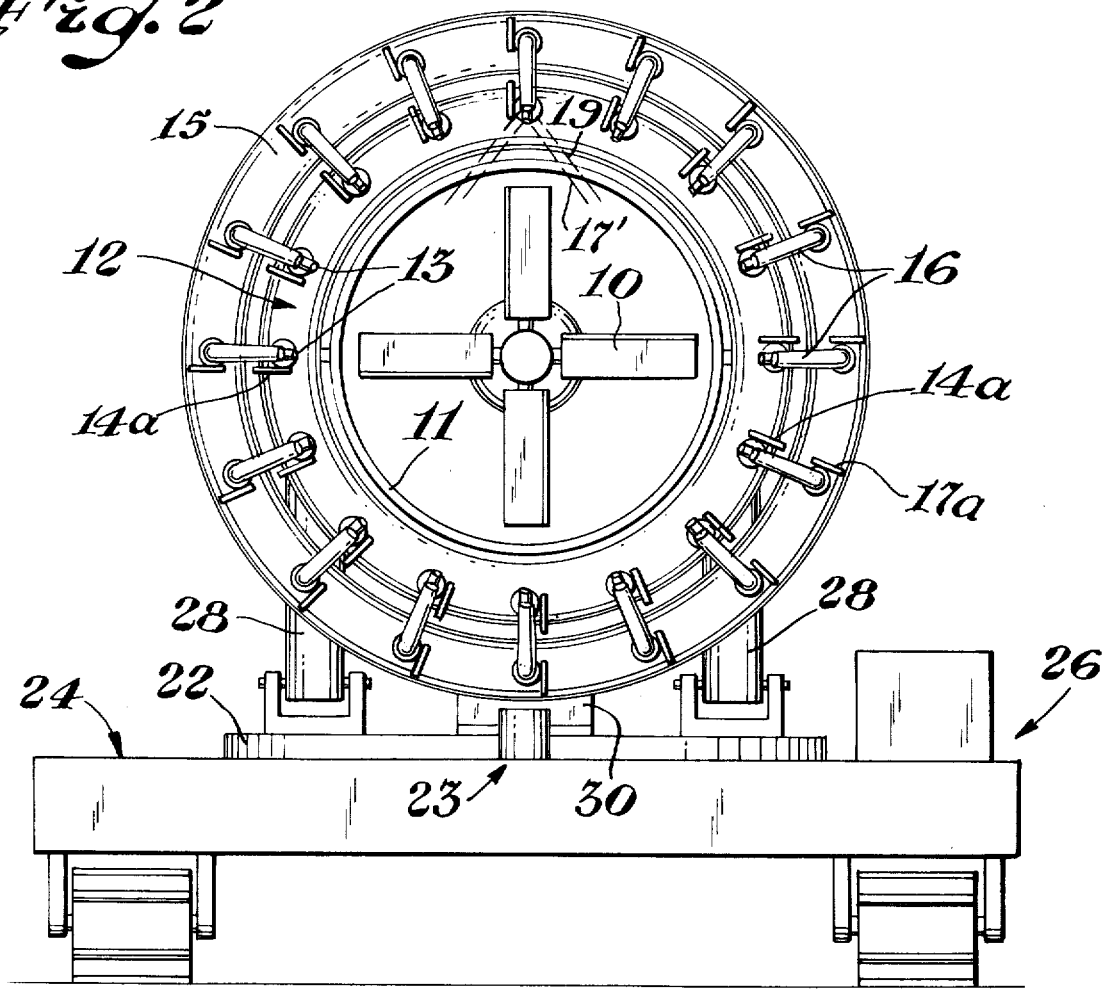
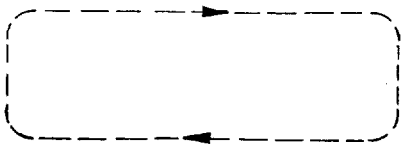
Fig. 4
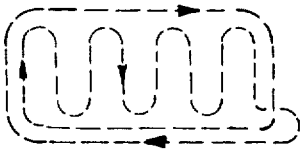
Fig. 5
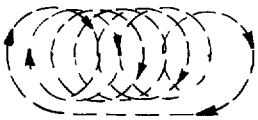
Fig. 6
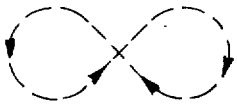
Fig. 7

SNOW MAKING METHOD

CROSS-REFERENCE TO RELATED APPLICATION

This application is a continuation-in-part of Application Ser. No. 497,839, filed Aug. 16, 1974 now abandoned.

SUMMARY OF THE INVENTION

This invention relates to an improvement in machines for making artificial snow of the type in which during operation a water spray is directed into a high volume unidirectional mechanical movement of air, such as generated by a fan, at substantially atmospheric pressure to effect crystallization of the droplets of water in the spray and subsequent deposition of the resultant crystals (hereinafter referred to as "snow") at a position remote from the snow-making machine as artificial snow by regularly redirecting the direction of the discharge end of the snow making apparatus during operation and to a new and useful method for efficiently producing such snow in substantially increased quantities and dispersions than has been realized heretofore with such snow making machines and apparatus.

BACKGROUND OF THE INVENTION

In the past number of years there has been a continuously increasing surge of interest in winter sports activities, particularly those activities which need a snow base for operation, e.g., skiing, snowmobiling, snowshoeing and the like. Unfortunately, in many areas of the world the natural snow fall is not predictable nor sufficient to assure continuous operation during the season of sports areas and resorts having facilities for such winter sports.

In more recent years continuity of operation and a good snow base has been gained by the use of artificial snow-making machines and apparatus. With such equipment snow-based winter sports activities have been continuously operated during the winter season and extended to geographical areas of the United States; for example, as far south as North Carolina, Virginia and Tennessee even though there is usually not sufficient natural snow in these areas to permit such sports on a regular basis during the season.

With artificial snow making equipment it is essential only that there be an ambient temperature below about 32° F. (0° C.) for a period sufficient to permit snow making to continue until an adequate depth of snow is deposited on the area, terrain or slope desired to be covered. In areas of North Carolina and Tennessee, for example, during a typical winter sports season there may be only 25 days with good conditions for making artificial snow. Farther north in Ohio 30 to 40 days snow making operation ordinarily can be expected and in Michigan 50 days or more are not uncommon. Therefore, it is important for effective operation that large volumes of snow be made rapidly during those periods when conditions are right for mechanical snow making.

The snow making apparatus and machines which have gained widespread commercial acceptance to date have all suffered from certain drawbacks which have led either to a low quality of snow, e.g., the deposited snow is too wet and/or resulted from a high energy input to low quantity of snow particle generation, thus being of a relatively low efficiency.

Illustrative of such apparatus is that disclosed by Pierce in U.S. Pat. No. 2,676,471. This machine mixes compressed air with water within a spray nozzle to effect particle formation of the water along with a cooling of the water which results from the adiabatic expansion of the compressed air. In commercial practice it has been found that the Pierce machine is highly susceptible to nozzle freezing. Additionally, excluding wind factors, this apparatus depends on the force of the compressed air and water themselves to move the freezing water particles beyond the immediate area of the nozzle. The heat of fusion of the freezing water particles requires considerable energy and results in excessive localized heating of the immediate ambient air when inadequate compressed air is present. Therefore, the volume of compressed air, and accordingly compressor capacity, required per unit volume of deposited snow is relatively quite high. While the examples in U.S. Pat. No. 2,676,471 show less than 1 gallon per minute, it is my understanding that this apparatus as modified since the patent issued and in operation under optimum atmospheric conditions, at a maximum, typically can crystallize about 20 gallons of water per minute, per nozzle, per 200 cubic feet per minute of compressed air. While Pierce, in column 7, alludes to oscillation of nozzles, he does not show oscillation in a manner such that the newly deposited snow is not touched by additional snow produced immediately thereafter. In fact, Pierce nowhere teaches that the battery of nozzles employed in his apparatus actually could oscillate, only that they may be oscillated during operation. Further, even if these were to be made to oscillate together, or independently, there is no way that snow particles resulting from such operation could be deposited on an area different from that struck by the immediately preceding particles. To oscillate the nozzles of the Pierce apparatus at best would provide a fan pattern or overlapping fan shape patterns where the particles generated by the nozzles would always be overlapping with the zone of the immediately preceding particles and contacting the portion of snow which was laid down immediately before. There would be no covering of a location different from that covered by the immediately preceding generated particles.

More recently, as described in my U.S. Pat. No. 2,968,164, a different type snow making apparatus has become commercially available. This machine includes a high powered fan for providing a substantially unidirectional high volume of air at substantially atmospheric pressure and in combination therewith an independent water spray providing means downstream from the fan. This water spray means is designed and positioned to provide a water spray which is injected into the high volume air movement from the fan at a rate and in a quantity sufficient to achieve crystallization of a substantial amount of the spray droplets and deposition of these as snow. This machine has the advantage that it operates without requiring the use of compressed air although compressed air can and often is used for nucleation. Other nucleation methods may also be used.

Eustis in U.S. Pat. No. 3,703,991 utilizes the principles of my earlier U.S. Pat. No. 2,968,164; i.e., a large fan is employed to move particles away from a spray nozzle, but also provides additionally a system wherein compressed air and water are mixed within a first seeding nozzle as taught earlier by Pierce and water is added to the fan moved air by a second exterior nozzle.

The seeding nozzles are disposed within the protective cowling of the fan; this can lead to frozen nozzles and increased mechanical difficulties in cleaning and repair. In commercial operations this apparatus has been shown to convert as much as two hundred to 250 gallons of water per minute into snow under optimum conditions.

Ericson, et al. in U.S. Pat. No. 3,610,527 have taught another modification of my earlier U.S. Pat. No. 2,968,164 whereby with an 18 or 20 inch fan blade from about 3 to about 140 gallons of water per minute can be converted into snow depending on the rate of rotation of the fan propeller, ambient temperature and relative humidity, and the temperature of the feed water.

Rice, in U.S. Pat. No. 3,838,815, described a blower projecting air and spraying water particles into the air stream. Hanson U.S. Pat. No. 2,968,164 was not cited in this patent. No significant commercial use of the Rice system is known to me.

A still more recent apparatus for making and depositing snow which has been observed in use comprises in combination a means for providing a substantially unidirectional large volume movement of air at atmospheric pressure and at a temperature below about 32° F., a first nozzle means providing a high velocity water spray directed into the unidirectional air movement at a first angle with respect to the direction of air movement and a second nozzle, distinct from the first nozzle, providing a high velocity air stream or air-water stream directed into the unidirectional air movement at a second angle with respect to the direction of movement of the air. The first and second nozzles are oriented with respect to one another such that during operation the air stream intersects the water spray at a point remote from the first and second nozzles. Operation of this apparatus provides a high dispersion of the water particles throughout the unidirectional air movement with resultant crystallization into snow particles and their deposition.

As indicated hereinbefore, each of these apparatus generates snow, some at higher volumes and rates than others, but all deposit the resultant snow particles on a fixed area, or in the case of oscillation of the Pierce battery of nozzles, over a wider area, but in any event such that substantially all of the generated snow particles fall onto particles that were immediately previously generated. (It is recognized, of course, that because of vagaries of natural air currents and wind some of the resultant snow may blow or drift away from the intended deposition site.) Generally, however, the bulk of the snow is aimed at and strikes a given area and as a predetermined depth is built up over a period of from less than ½ hour to 24 hours or more the apparatus is then moved and repositioned to have the snow deposited on a different area. Not only is this operation cumbersome and requires manpower to shut down and bodily move the rig from position to position, but more importantly, the continuous deposition of this still wet snow particles onto previously deposited particles which have not yet completely frozen can lead to icing conditions which are not desired by ski area operators and skiers alike. Alternatively, if the quantity of water put through the machine is reduced, the quantity of snow produced is reduced with the attendant economic disadvantages.

Now, unexpectedly, I have discovered a new and useful improvement in snow making apparatus of the type which operate by introducing water particles, e.g. a water spray, into a large volume unidirectional mechanical movement of air ordinarily generated by a fan or propellor at substantially atmospheric pressure and at a temperature of below 32° F. whereby volumes of water much larger than useable heretofore are converted into high quality snow particles and these effectively directed over a greater area than realized heretofore. Further, the resultant snow product is deposited onto previously deposited snow which has aged or has completely frozen into relatively dry crystalline snow particles, thus producing a particulated snow base of excellent quality.

The present invention will be fully understood from the detailed description presented hereinafter in the specification when read in conjunction with the Figures of the drawing.

BRIEF DESCRIPTION OF THE FIGURES OF THE DRAWING

FIG. 1 is a side elevation, partially cut away, of one embodiment of the improved snow making apparatus of the present invention.

FIG. 2 is an end view of the snow making apparatus of FIG. 1 in a horizontal position looking towards the discharge end of the apparatus.

FIG. 3 represents schematically the areas of snow condition as viewed from above as the snow particles are distributed by a typical snow making machine.

FIG. 4 is a line diagram depicting schematically one preferred snow distribution pattern as viewed facing the pattern; i.e., looking at the discharge port of a snow making machine developed in operation of the snow making apparatus of the present invention.

FIG. 5 is a line diagram depicting schematically another snow distribution pattern, as viewed facing the pattern; i.e., looking at the discharge port of a snow making machine, developed in operation of the snow making apparatus of the present invention.

FIG. 6 is a line diagram depicting schematically another snow distribution pattern as viewed facing the pattern; i.e., looking at the discharge port of a snow making machine developed in operation of the snow making apparatus of the present invention.

FIG. 7 is a line diagram depicting schematically another snow distribution pattern as viewed facing the pattern; i.e., looking at the discharge port of a snow making machine, developed in operation of the snow making apparatus of the present invention.

DESCRIPTION OF PREFERRED EMBODIMENTS

In general the improved apparatus of the present invention comprises employing in combination with a snow making machine comprising a fan or propellor means for generating a unidirectional large volume of movement of air and a water spray generating means which machine operates by spraying water droplets into a large volume mechanically generated movement of unidirectional air, said air having a temperature below 32° F., at substantially atmospheric pressure, a means for regularly redirecting the position and direction of the outlet; i.e., particle discharge end, of the apparatus. This assures that the resultant snow particle laden air stream is distributed in a predetermined moving pattern covering an area much greater than the area defined by the pattern of snow particles generated by the snow making machine and issuing from the discharge thereof and the snow particles in the air stream are directed towards a portion of the atmosphere different from that contacted by immediately previously generated snow particles and are deposited onto a different locus than such immediately previously generated particles.

In the practice of the invention, it is essential that the cross-sectional area covered by the regularly directed moving pattern of snow particles be at least three times that covered by the pattern of particles generated by the discharge end of the snow making apparatus. The two factors, taken in combination, of providing a moving pattern for the generated snow particles such that the cross-sectional area covered during application is at least three times that of the area covered by the snow particle pattern provided by the discharge end of the snow making apparatus and having the snow pattern movement at such a rate that the snow particles are deposited onto a different locus than the immediately previously generated particles are critical to the successful operation of the present invention and define the contribution of the present advance in the art of snow making.

As shown by the representative snow patterns depicted by the illustrative line diagrams of FIGS. 4, 5, 6 and 7 the object of the present invention can be achieved in a variety of ways. Although I do not wish to be bound by any particular theories or modes of operation to explain the operation of my invention, it is my belief that with my improved apparatus as shwon by the snow distribution pattern of FIG. 3 which illustrates the deposition pattern for any given position of the particle discharge end of the machine newly formed "relatively wet" snow particles which might strike the ground before passing through the "intermediate" stage to the desired "relatively dry" stage have a considerably longer period to freeze and crystallize; i.e., dry, before being struck by additional newly formed relatively wet particles of snow which strike the same ground area as the cyclic movement of my improved apparatus is repeated at a later timed interval.

Those skilled in the art of making artificial snow have developed criteria for defining the snow qualities set forth directly hereinbefore. These qualities, which to one not skilled in the snow making art, may seem to be somewhat arbitrary and qualitative, actually are quantified and have been accepted throughout the snow making industry as defined standards. Three terms are widely used throughout the industry to define the condition of the snow being generated. These terms are: "relatively wet", "intermediate" and "relatively dry". "Relatively wet" artificial snow is known as that which will ooze water when a mass of such snow is picked up in the hand from that which has been deposited and squeezed. "Intermediate" artificial snow will form a dense ball when squeezed in the hand without any substantial release of water while "relatively dry" snow will lightly pack with no significant adhesion of particles such that no tight snow ball can be formed.

For optimum build up with the best quality for skiing "intermediate" artificial snow is preferred. Ordinarily in the practice of my invention a snow making machine is fitted with a means which provides for controlled movement of at least the snow particles discharge end in horizontal or vertical directions or a combination of horizontal, vertical and angular directions, (by angular direction is meant a movement having both vertical and horizontal components), such that the particle discharge portion of the apparatus moves a total of at least 50 angular degrees every 5 minutes and covers an area of at least three times that of the area of the snow pattern formed by the snow maker. The particle discharge end of the snow making machine should produce a snow pattern having a pattern covering an area at maximum one third of that covered by the deposited snow particle pattern formed by the regular movement of the discharge end of the snow making machine when operated in accordance with the practice of the present invention. During operation the snow pattern issuing from the discharge end of the snow making apparatus should have a horizontal plume arc of less than 35° in windless conditions. This relatively unidirectional plume (in combination with the motion defined herein) assures that the plume contacts "new" air and deposits snow intermittently on any specific point on the surface of the ground. Further, to assure that the water particles have sufficient residence time in the cold ambient air in order to become at least partially crystallized, most of the water particles should be thrown outwardly or carried at least 40 feet from the exit of the machine. Preferably, the total movement of the discharge end will be at least 200° every 5 minutes with outstanding results being achieved at a rate of at least 20 total degrees every 2 seconds. For most commercial size operations and using maximum quantities of water, the maximum rate of apparatus motion will be a total of about 70° every 5 seconds of operation. Of course, if the machine is sufficiently powerful and if the conditions warrant, the rate of apparatus motion can be as great as 90° per second. Generally, at lower ambient temperatures the rate of motion can be slower for snow formation with a given quantity of water than at higher temperatures approaching 32° F. (0° C.). For economic reasons, of course, if the water supply is adequate, the water quantity will be increased and the motion maintained at the same rate or increased at the lower temperatures. At the faster rates of motion, greater amounts of snow can be made in a given period of time. Stated another way, in a preferred operation the regular movement of the discharge end of the snow making machine will be such that the newly deposited snow will not be covered by fresh particles for at least 1 second, preferably 2 seconds. Thus, the newly deposited snow is "left alone" for at least one second, preferably at least 2 seconds. Even more desirable, the newly deposited snow is "left alone" for greater periods of time before newly generated snow is deposited thereon.

In a preferred embodiment, the snow machine is maintained in substantially constant motion within the ranges set forth hereinbefore. Further, to assure maximum production of high quality, relatively dry snow deposition, the motion will not be in a single plane or along a single direction but will be in a cyclic, repetitive pattern as shown in the illustrative schematic diagram of FIG. 4, or in other predetermined patterns. In actual operation, the pattern of FIG. 4 generally will have a lower horizontal arc of from about 30 to about 120° followed by an upward vertical arc of from about 15° to about 60°. This vertical segment is followed by a horizontal arc of total degrees equal to the first arc but in a direction opposite that of the lower horizontal sweep and a final downward vertical arc equal in degrees to the vertical upward swing whereupon the sequence is repeated until the desired depth of snow is realized.

Other operable apparatus movements can be a series of horizontal sweeps, smaller circular vertical loops in a sweeping spiral motion, a series of elliptical loops, offset rectangular patterns, single circle, elliptical configurations, figure eight patterns and the like to achieve a predetermined snow particle discharge pattern.

In certain operations, advantageously the discharge port of a snow making machine can be elevated to a given position and held there and the apparatus then subjected to back and forth horizontal sweeps within the angular degree and time ranges set forth hereinbefore.

The actual motions of the snow making machine can be achieved with any of a number of mechanical, electrical, hydraulic, pneumatic, servo-mechanical, mechanical-electrical, electrical-hydraulic, mechanical-pneumatic, electrical-pneumatic, mechanical-hydraulic or other such systems which will provide a controlled movement of the high velocity air discharge or discharge port of the machine in predetermined directions and ranges or in predetermined desired patterns. More specifically, gear-cam assemblies, belt driven pulleys, hydraulic cylinder assemblies, hydraulic motors with limit switches or combinations of these advantageously are employed in the improved apparatus of my invention. The vertical motion is readily accomplished by a hydraulic cylinder jack assembly while the horizontal motion is readily accomplished with a hydraulic motor or motor-gear assembly. These are operated either automatically or manually at the snow making machine itself or remotely. A particularly advantageous system employs a feed-back program to establish the desired vertical and horizontal limits by initiating and terminating the various motions of the machine whereby the operation is substantially operator free.

In one preferred embodiment excellent results have been achieved with a combination of at least one vertically oriented hydraulic cylinder jack attached both to the outer shroud of a snow making machine and to a horizontally pivotal base, said horizontally pivotal base also supporting said snow making machine. Such an arrangement provides for either horizontal rotation alone while the discharge port is maintained at a predetermined vertical elevation, or for vertical rotation while the discharge port is maintained at a predetermined horizontal position, or a combination of vertical, horizontal and angular movements which can provide an infinite number of cyclic machine discharge port movements and snow depositions.

It is to be understood that, if desired, the present improved apparatus can be fitted with a manually operated or automatically controlled wind direction sensing gauge and snow machine compensating control mechanism to achieve adjustment of the direction of the discharge port with changes in wind direction. This is desirable since optimum in long range deposition of the snow particles is achieved when the apparatus is operated with the discharge port pointing downwind. Ordinarily the machine will not be operated such that the exit port is at an angle greater than 135° to either side of the downwind direction.

One exemplary, preferred apparatus of the present invention is that illustrated by FIGS. 1 and 2 of the drawing. In this embodiment the basic snow making machine comprises a power driven propellor 10 which during operation generates a substantially unidirectional large volume movement of air at substantially ambient atmospheric pressure. The power source for the propellor 10 can be an electric motor, as shown, or a separate gasoline or diesel powered engine and belt assembly, or a power take off unit from a vehicle, which vehicle then also can serve as a portable mount for the apparatus. The propellor 10 is mounted within an associated shroud or bonnet cowling 11. Circumferentially surrounding the bonnet 11 and mounted thereon in proximity to the exit port 11*a* thereof is an annular water manifold 12 which during operation is connected via water line 12*a* to a suitable water supply (not shown) maintained at a pressure preferably in the range of from about 70 to about 400 p.s.i.g. Manifold 12 supports a plurality of nozzles 13 each individually connected in fluid communication with manifold 12 and each oriented to provide, during operation, a water spray 18 into the unidirectional movement of large volume of air at a first angle A with respect to the direction of movement thereof. Water spray nozzles 13 preferably are of the known helical or corkscrew type which produce a uniform dispersion of water droplets throughout a generally conical spray pattern. The water flow through each nozzle 13, during operation, is individually adjustable by manipulating either automatically, or mechanically, the external arm 14*a* of a throttle valve 14.

Concentric with water manifold 12 but of larger overall diameter is a compressed air manifold 15 which is connected via a compressed air line 15*a* to a suitable source of compressed air which during operation is maintained at a pressure preferably in the range of from about 40 to about 250 p.s.i.g. A second plurality of nozzles 16 is mounted onto and connected in fluid communication with manifold 15 such that each nozzle 16 provides a high velocity air stream 19 of limited low volume directed into the unidirectional movement of the large volume air stream at a second angle B with respect to the direction of movement thereof. During operation the air flow through each nozzle 16 is individually adjustable, either automatically or mechanically manipulating the external arm 17*a* of a throttle valve 17.

Air nozzle 16 is positioned radially outwardly from water nozzle 13 and oriented with respect thereto such that during operation air stream 19 intersects water spray 18 at a point 20 remote from the air nozzles 16 and water nozzles 13. It is to be understood that the placement of the water manifold 12 and compressed air manifold 15 with their attendant nozzle assemblies can be reversed such that the water manifold is the outermost and the air manifold is adjacent the shroud 11. It should also be understood that water can be introduced into manifold 15 so that a mixture of compressed air and water is released from nozzle 16 whereby snow is made upon the mixture of compressed air and water exiting from nozzle 16.

My improvement to basic snow machines as exemplified by the illustrated embodiment is comprised of a circular base bull gear plate 22 of structural strength sufficient to support the snow making machine. Thus bull gear plate 22 is driven by power driven geat mechanism 23 which can give horizontal rotation both clockwise and counter-clockwise. These are fitted into a framework or otherwise mounted on the bed 24 of a shelf propelled portable vehicle 26 if such is used to transport the snow making apparatus, or onto a sled or trailer type support vehicle, or other carrying device. The gear plate 22 is mounted so as to cooperate with the fixed bed 24, or other support frame and thus be controllably rotatable in a horizontal plane. Conveniently, such rotation is achieved by a drive gear-ring gear assembly, power driven belt-pulley or gear-sprocket-chain mechanism, friction wheel drive or other known drive means for imparting horizontal rotational movement.

Also having one end mounted on plate 22 and the other end attached to the shroud 11 of the snow making machine usually at a position from its midpoint to near the discharge end 11*a* is at least one hydraulically operated extendable-retractable jack assembly 28. This assembly 28 during operation provides for controlled vertically raising and lowering of the discharge port 11*a* of the snow making apparatus. Conveniently, as shown, two of the hydraulic jack assemblies 28 are used, one each placed on opposite sides of the shroud 11. Also, if desired, as shown for added support the rear end of the snow making machine can be fastened to plate 22 by means of a hinged support member 30.

Other means can be used to effect the desired vertical movements of the machine. For example, the snow machine can be set in a framework having a fixed pivot point along the side of the shroud, such as at the normal load balance point of the apparatus. This unit can have a pulley-belt assembly or a sprocket-chain combination, or gear drive, for example, to effect controlled vertical rotation up and down about the pivot point.

In order to get adequate throw, properly utilize manpower and have a reasonably efficient machine and process, a machine capacity of at least 20 gallons per minute of water at temperatures below 15° F. (−9.5° C) should be provided.

Although my improvement has been shown for illustrative purposes to be in combination with one particular type of snow making apparatus, it is to be understood that I consider my invention to be operable with other systems operating within the scope set forth hereinbefore.

The following Example will serve to further illustrate the apparatus of the present invention and its operability.

EXAMPLE

A blower powered by a 68 horsepower (at 2800 R.P.M.) engine and fitted with a shroud capable of producing about 28,000 cubic feet per minute of a unidirectional volume of ambient air is provided. At the output end of the shroud 14 No. 10 Beta Fog Brass Nozzles (Greenfield, Mass. are mounted on the periphery of the shroud. Each nozzle has a shut off valve and each nozzle is connected to a water supply. The nozzles are fixed in a position so as to direct the output towards the center of a center line through the apparatus as shown in FIG. 1. A standard air-water gun as described in U.S. Pat. No. 2,676,471 is mounted at the bottom of the shroud at the output end with the gun pointed toward the center of the high volume air stream which exits from the shroud. About 70 p.s.i.g. air is provided to the air-water gun in a quantity adequate to push out, break-up and cause freezing as crystallized water of about 15 gallons per minute of water having a pressure of about 300 p.s.i.g. The pattern defined by the snow particles exiting from the discharge end of the apparatus was substantially circular in shape and defined a cross-sectional area of about 2000 square feet. The air-water gun is connected to a supply of water. In a control study with the discharge end in a fixed position by operating the above apparatus on a ski slope and by varying the number of nozzles used and the amount of water passed through the nozzles results to obtain a maximum quantity of good quality snow as summarized in Table I were achieved on relatively windless days.

In a second study, this same apparatus, except that it was fitted with means which provided for horizontal, vertical and angular movement of the blower discharge end, was used. During this study the discharge end of the apparatus was constantly oscillated in a substantially rectangular pattern as follows, a 90° arc horizontally, a 20° arc vertically upward, a 90° arc horizontally in the opposite direction to the dirst horizontal sweep and a 20° arc vertically downward. This moving pattern of 220 total degrees was completed in about 20 seconds; repetitive cycles were followed. The total area covered by the substantially rectangular snow pattern formed by this regular movement of the discharge end of the snow making apparatus was 10,000 square feet. Further, during operation substantially all of the snow particles were deposited onto a fresh area and did not fall on particles generated immediately before.

During this study as many nozzles as possible were opened so as to get the maximum amount of snow while still maintaining good quality; i.e., intermediate snow.

The results of this study and the control conducted at various temperatures which are summarized in Table I presented hereinafter clearly establish the unexpected and superior performance characteristics of my invention.

TABLE I

| Ambient Temp. ° F | Nozzles Used | Water Input Gals./Min. | Snow Quality |
|---|---|---|---|
| CONTROL - Stationary Placement of Snow Making Apparatus | | | |
| 16 | 9 | 106.2 | Intermediate |
| 24 | 6 | 70.8 | Intermediate |
| 26 | 4 | 47.2 | Intermediate |
| 29 | 3 | 35.4 | Intermediate |
| OSCILLATING Snow Making Apparatus | | | |
| 16 | 14* | 165.2* | Intermediate |
| 24 | 12 | 141.6 | Intermediate |
| 26 | 8 | 94.4 | Intermediate |
| 29 | 6 | 70.8 | Intermediate |

*Maximum number of nozzles available on apparatus used; this volume reflects the maximum throughput capacity of this number of nozzles; more water could have been used if more nozzle capacity had been present.

The term "intermediate" as applied to snow quality indicates the freshly generated snow particles formed a dense ball without any substantial release of water when a mass of these is squeezed in the hand, as defined hereinbefore, with the deposited snow mass being suitable for skiing. Several snow making experts were asked to judge the snow on the basis of "intermediate", "relatively wet", and "relatively dry." Their unanimous opinion in both tests was that the snow was "intermediate."

I claim:

1. In a method for producing artificial snow in a snow making machine which operates by introducing a water spray into a fan-generated large volume unidirectional mechanical movement of air at substantially atmospheric pressure and at a temperature of below 32° F., thereby to effect at least partial crystallization of the droplets of water in the spray, the improvement which comprises regularly redirecting the position and direction of the resultant snow particle laden air stream in a predetermined moving pattern such that the snow particles in the air stream are directed towards a portion of the atmosphere different from that contacted by immediately previously generated snow particles and are deposited onto a different area than such immediately previously generated particles and the cross-sectional area covered by the regularly directed moving pattern of said snow particles is at least three times greater than that covered by the pattern of particles generated by the discharge end of said snow making machine.

2. The improved process as defined in claim 1 wherein the snow particle laden air mass is directed into the atmosphere from the exit port of a snow making machine in a combination of horizontal, vertical and angular directions having both vertical and horizontal components such that the discharge port of said machine moves a total of at least 50 angular degrees every five minutes.

3. The improved process as defined in claim 2 wherein the exit port of said machine is directed in a continuous regular repetitive pattern such that the total movement is at least 20° every 2 seconds.

4. The improved process as defined in claim 2 wherein the discharge port of said machine is moved over a horizontal arc of from about 30° to about 120° followed by an upward vertical arc of from about 15° to about 60°, followed by a horizontal arc of total degrees equal to that of the first arc but in a direction opposite that of the first horizontal arc and a final downward vertical arc equal in degrees to the previous vertical upward swing, and the sequence is repeated until the desired depth of snow is realized.

5. The improved process as defined in claim 1 wherein the snow particle laden air mass is directed into the atmosphere from the exit port of a snow making machine in alternating horizontal clockwise and counter-clockwise movements.

* * * * *